United States Patent [19]

Kwatnoski et al.

[11] 4,338,862

[45] Jul. 13, 1982

[54] BULLET NOSE FILLER FOR IMPROVED LETHALITY

[75] Inventors: Richard Kwatnoski, Lumberville, Pa.; Robert J. McHugh, Willingboro, N.J.

[73] Assignee: The United States of America as represented by the Secretary of the Army, Washington, D.C.

[21] Appl. No.: 620,476

[22] Filed: Oct. 3, 1975

[51] Int. Cl.[3] ..... F42B 11/08

[52] U.S. Cl. ..... 102/516; 102/430; 102/501

[58] Field of Search ..... 102/38, 91, 92, 92.1–92.7, 102/501, 507, 508, 510, 514–519, 430

[56] References Cited

U.S. PATENT DOCUMENTS

| | | | |
|---|---|---|---|
| 3,282,214 | 11/1966 | Briscoe | 102/91 |
| 3,348,486 | 10/1967 | Rapp | 102/92.3 |
| 3,357,357 | 12/1967 | Voss | 102/92.3 |

FOREIGN PATENT DOCUMENTS

| | | | |
|---|---|---|---|
| 115476 | 5/1918 | United Kingdom | 102/92.5 |
| 887124 | 1/1962 | United Kingdom | 102/52 |
| 1038702 | 8/1966 | United Kingdom | 102/91 |

OTHER PUBLICATIONS

"The Condensed Chemical Dictionary", 8th Ed., Van Nostrand, Reinhold Co., 1971, p. 350.

*Primary Examiner*—Harold J. Tudor
*Attorney, Agent, or Firm*—Nathan Edelberg; Robert P. Gibson; A. Victor Erkkila

[57] ABSTRACT

Small arms projectile wherein lead core thereof has its front or nose portion replaced with a structurally integral low-density plastic filler material, the filler material shearing from the lead core to provide a double wound tract upon slight penetration of the projectile into a soft target.

1 Claim, 2 Drawing Figures

BULLET NOSE FILLER FOR IMPROVED LETHALITY

The invention described herein may be manufactured, used and licensed by or for the Government for governmental purposes without the payment to us of any royalty thereon.

This invention relates to projectiles and more particularly concerns small arms projectiles having a low-density filler material at the nose portion of the projectile for increasing its lethality against soft targets.

Conventional bullets remain intact upon striking a soft target, such, for example, as a human body, to cause substantially a single wound tract. While conventional bullets may tumble after impacting a soft target to thus increase lethality of the bullet, frequently the bullet will start its tumbling action only after much of the body has been penetrated, and oftentimes, depending upon the configuration and velocity of the bullet and the distance of the weapon from the target, tumbling will not occur until about 6 or more inches of the body has been penetrated. Thus, in many instances, the bullet will have already completely penetrated enemy personnel before any tumbling action commences.

Prior art methods for improving bullet lethality generally involved alteration of the external configuration of the bullet, i,e., flechettes, sabotted bullets, and the like. Flechettes are difficult to manufacture precisely and tend to be unstable in flight. Similarly, sabotted bullets require auxiliary means for positioning the bullet and are thus costly to manufacture and not sufficiently mass-produceable in times of mobilization.

Use of several other types of small arms projectiles having good lethality have been declared illegal by the Geneva Convention.

It is thus an object of this invention to provide a small arms projectile or bullet having improved lethality.

Another object of the invention is to provide such a bullet which requires no alteration of exterior configuration thereof.

Still another object of the invention is to provide such a bullet which can be readily and economically mass-produced.

The exact nature of the invention as well as other objects and advantages thereof will be readily apparent from consideration of the following specification relating to the annexed drawings wherein like numerals represent like parts and wherein.

Figure 1:
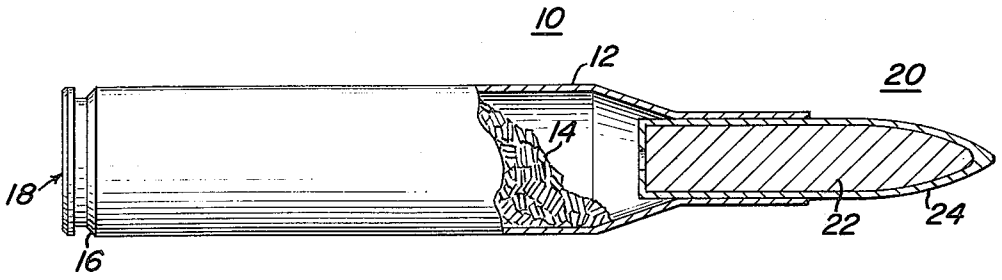
Fig. 1 PRIOR ART
FIG. 1 represents a cutaway sectional view of a conventional or prior art small arms cartridge.

Referring now to FIG. 1 of the drawings, there is shown a standard or conventional 7.62 mm cartridge 10, having case wall 12, propellant 14, extracting groove 16, and head 18. The projectile or bullet 20 is similarly of conventional design and includes heavy metal core 22 of lead encased within jacket 24, conveniently gilding metal.

Figure 2:
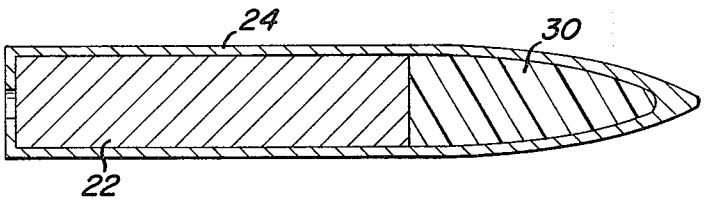
FIG. 2 is a sectional view of the bullet of FIG. 1 modified in accordance with our invention.

Referring now to FIG. 2, the bullet or projectile is modified in accordance with our invention such that the exterior configuration thereof remains unaltered, but forward portion of lead core 20 is replaced by a structurally integral low density nose filler 30, suitably of plastic. By reason of this modification, the amount of energy transferred to a soft target will be materially increased, to be described hereinafter, to thus enhance lethality of small arms projectiles, and particularly for military applications.

When our improved projectile was fired into a test block of gelatin, approximately 15"×7"×7" is size, the projectile entering that face of the block which would permit 15" of travel therethru, tumbling action commenced at about 4.0" and 4.5" from the impact face of the block when the projectile was fired from distances of 50 and 100 meters respectively. When standard lead core and M62 tracer bullets were similarly fired from similar distances from similar cartridges, tumbling of the bullets commenced at about 6.4" and 6.5". Thus, it can readily be appreciated that, in many instances, with conventional small arms projectiles, the total kinetic energy of the bullet will not be expanded in the soft target, but may penetrate the body, with or without tumbling, or may tumble substantially at the far portion of the body.

The density of our nose filler material should fall within the range of about 0.9 to 3.0 gm/cc. Stability and tumbling action are deleteriously affected when density falls below about 0.9 while delayed tumbling occurs when the density exceeds about 3.0.

Plastic materials intended to be covered by this invention includes any thermoplastic materials whatsoever which will not readily shatter or crush, either upon impact or tumbling. In other words, the nose filler material should possess structural integrity sufficient to withstand such impact or tumbling.

Plastics are preferred for our nose filler material. A predetermined amount can readily be poured into the hollow bullet jacket, allowed to harden or set, and the lead core 22 (FIG. 2) placed thereover. No bonding should occur between the lead and plastic. Ceramic nose fillers although not preferred, may be used advantageously under certain conditions, and ordinarily will be shaped prior to insertion into the hollow bullet jacket. As with the plastic material, no bonding of the ceramic with the lead should occur.

Optimally, the nose filler should comprise about 20 to 40% of the length of the projectile. When made substantially shorter, tumbling and splitting away of the nose filler from the lead to form a separate wound tract is delayed; whereas flight performance is jeopardized when nose filler lengths are caused to be substantially greater than about 40% of the projectile length.

Fabrication of our small arms projectile or bullet for a 7.62 mm cartridge is illustrated by the following examples:

EXAMPLE I 0.07 g of a polycarbonate resin were poured into a hollow 7.62 mm bullet jacket to produce a nose filler in accordance with our invention. The solidified plastic had a specific gravity of approximately 0.95 and measured 0.76 cm in length. A lead core, 1.37 cm long, weighing 3.93 g, was inserted over the plastic nose filler as shown in FIG. 2 of the drawings. The bullet had an overall length of 3.37 cm. When the bullet was fired into a gelatin block as aforedescribed, tumbling commenced at about 4.5" from the impact face of the block when the bullet was fired from a distance of 100 meters. A double wound tract was provided.

EXAMPLE II

Same as Example I, except 0.20 g of an epoxy resin was used, having a solidified specific gravity of 1.02 to produce a nose filler 1.27 cm in length. The lead core was 0.86 cm long, weighing 2.61 g. Tumbling commenced at about 4.5 inches from the impact face of the block when the bullet was fired at a distance of 50 meters.

It is apparent from the foregoing description that we have provided a bullet for small arms weapons, up to about .60 calibre, having improved lethality against soft targets, the bullet itself requiring no alteration of exterior configuration whatsoever from conventional military design.

We claim:

1. In a small arms cartridge, said cartridge having a case wall and a propellant therewithin; a head portion including means for igniting said propellant, the combination therewith of a projectile for increasing lethality of said projectile against soft targets by tumbling of said projectile therewithin substantially sooner than standard lead core and tracer bullets fired from similar cartridges and distances, a hollow metal jacket having a closed tip end, a structurally integral nose filler contained within a forward portion of said jacket, said nose filler comprising a thermoplastic resin having a specific gravity ranging between about 0.95 and 1.02 gm/cc, and about 20 to 40% of the length of said projectile, a heavy metal core within said jacket rearwardly adjacent said nose filler, said projectile forming a double wound tract in said soft target when said nose filler shears from said heavy metal core upon slight penetration of said projectile into said soft target.

* * * * *